US006629711B1

(12) United States Patent
Gleason et al.

(10) Patent No.: US 6,629,711 B1
(45) Date of Patent: Oct. 7, 2003

(54) UNIVERSAL ACTUATOR ASSEMBLY FOR A DOOR LATCH

(75) Inventors: Stephen J. Gleason, Charles City, IA (US); David Alcantara, New Hampton, IA (US); Kenneth William Bryant, Bellevue, WA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 09/797,289

(22) Filed: Mar. 1, 2001

(51) Int. Cl.[7] ..... E05C 3/06

(52) U.S. Cl. ..... 292/216; 292/244; 292/201; 292/DIG. 23

(58) Field of Search ..... 292/216, 336.3, 292/DIG. 23, 169.14; 70/263, 264, 237

(56) References Cited

U.S. PATENT DOCUMENTS

| | | | | | |
|---|---|---|---|---|---|
| 4,049,305 | A | | 9/1977 | Zetterlund et al. | 292/336.3 |
| 4,131,002 | A | | 12/1978 | Gianelo | 70/84 |
| 4,268,077 | A | | 5/1981 | Bohleen et al. | 292/336.3 |
| 4,420,954 | A | | 12/1983 | Hieronymi et al. | 70/150 |
| 4,438,964 | A | | 3/1984 | Peters | 292/216 |
| 4,494,783 | A | | 1/1985 | Poe | 292/155 |
| 4,588,219 | A | | 5/1986 | Kobayashi et al. | 292/336.3 |
| 4,703,963 | A | | 11/1987 | Ball | 292/336.3 |
| 4,743,052 | A | | 5/1988 | Stammreich et al. | 292/113 |
| 4,775,176 | A | * | 10/1988 | Ikeda | 292/216 |
| 4,796,929 | A | * | 1/1989 | Gergoe | 292/28 |
| D303,618 | S | | 9/1989 | Russell et al. | D8/306 |
| 4,882,919 | A | | 11/1989 | Craig | 70/208 |
| 4,889,373 | A | | 12/1989 | Ward et al. | 292/336.3 |
| 4,913,477 | A | | 4/1990 | Watanuki et al. | 292/216 |
| 4,929,007 | A | * | 5/1990 | Bartczak et al. | 292/216 |
| 5,174,619 | A | | 12/1992 | Bender et al. | 292/336.3 |
| 5,248,175 | A | | 9/1993 | Burns | 292/347 |
| 5,265,450 | A | | 11/1993 | Doyle | 70/118 |
| 5,295,374 | A | | 3/1994 | Bender et al. | 70/208 |
| 5,348,357 | A | * | 9/1994 | Konchan et al. | 292/216 |
| 5,355,554 | A | | 10/1994 | Magoon | 16/124 |
| 5,570,915 | A | | 11/1996 | Asadurian | 292/242 |
| 5,611,224 | A | | 3/1997 | Weinerman et al. | 70/208 |
| 5,636,880 | A | | 6/1997 | Miller et al. | 292/144 |
| 5,649,726 | A | * | 7/1997 | Rogers et al. | 292/201 |
| 5,689,980 | A | | 11/1997 | Weinerman et al. | 70/208 |
| 5,746,458 | A | | 5/1998 | Fisher | 292/252 |
| 5,749,611 | A | * | 5/1998 | Watson et al. | 292/336.3 |
| 5,820,174 | A | | 10/1998 | Parikh et al. | 292/126 |
| 5,875,948 | A | | 3/1999 | Sadler | 224/404 |
| 5,941,104 | A | | 8/1999 | Sadler | 70/208 |
| 5,971,449 | A | * | 10/1999 | Rogers et al. | 292/216 |
| 5,983,682 | A | | 11/1999 | Parikh | 70/208 |

* cited by examiner

*Primary Examiner*—Robert J. Sandy
*Assistant Examiner*—Dinesh N Melwani
(74) *Attorney, Agent, or Firm*—McKee, Voorhees & Sease, P.L.C.

(57) ABSTRACT

The universal logic assembly of the present invention is non-handed so as to be adapted for use both left-hand and right-hand vehicle door structures. The logic assembly includes a mounting bracket adapted to be attached to the inside of the door structure, with the latch assembly sandwiched therebetween. A plurality of lever arms are pivotally mounted on the bracket, with each arm having opposite front and back sides. A plurality of clips are mounted on the lever arms to receive rods and/or cables from the door handles and lock mechanism so as to control the opening and closing of the latch. The clips can be mounted from both the front and back sides of the arms, such that the logic assembly is a non-handed universal product.

17 Claims, 6 Drawing Sheets

UNIVERSAL ACTUATOR ASSEMBLY FOR A DOOR LATCH

BACKGROUND OF THE INVENTION

In vehicle doors, latches are provided for retaining the door in a closed position, with an associated actuator or logic assembly to control opening and closing of the door, as well as locking and unlocking of the latch mechanism. Conventionally, the latch and logic assemblies are manufactured for exclusive use on either the left-hand door or the right-hand door. Such handed logic assemblies require manufacture of mirror-image components for use on one door or the other, which necessarily increases manufacturing costs. Also, installation is more complicated, since the installer must determine whether he or she is using a left-handed or right-handed logic assembly.

Therefore, a primary objective of the present invention is the provision of a universal logic assembly which can be used on both left-hand and right-hand doors.

Another objective of the present invention is the provision of a universal logic assembly which minimizes manufacturing costs and simplifies installation.

A further objective of the present invention is the provision of a universal logic assembly for a door latch which is economical to manufacture and durable in use.

These and other objectives will become apparent from the following description of the invention.

SUMMARY OF THE INVENTION

The universal actuator or logic assembly of the present invention is adapted for use with a latch mounted in a vehicle door structure. The logic assembly includes a mounting bracket adapted to be attached to the latch and to the door structure. A plurality of lever arms are pivotally mounted on the bracket, with each arm having opposite front and back sides. The arms include a lock arm pivotally mounted to the bracket, an outside release arm pivotally connected to the bracket, a link arm pivotally connected to the lock arm and to the outside release arm, an inside release arm pivotally connected to the bracket, and a spring arm pivotally connected to the bracket. A plurality of clips are mountable from both the front and back sides of the lock arm, outside release arm, and inside release arm, such that the logic assembly can be universally used on both left-hand and right-hand door structures. Thus, for left-hand door structures, the clips are mounted on one side of the arms, while the clips are mounted on the opposite side of the arms for a right-hand door structure.

DETAILED DESCRIPTION OF THE DRAWINGS

Figure 1:
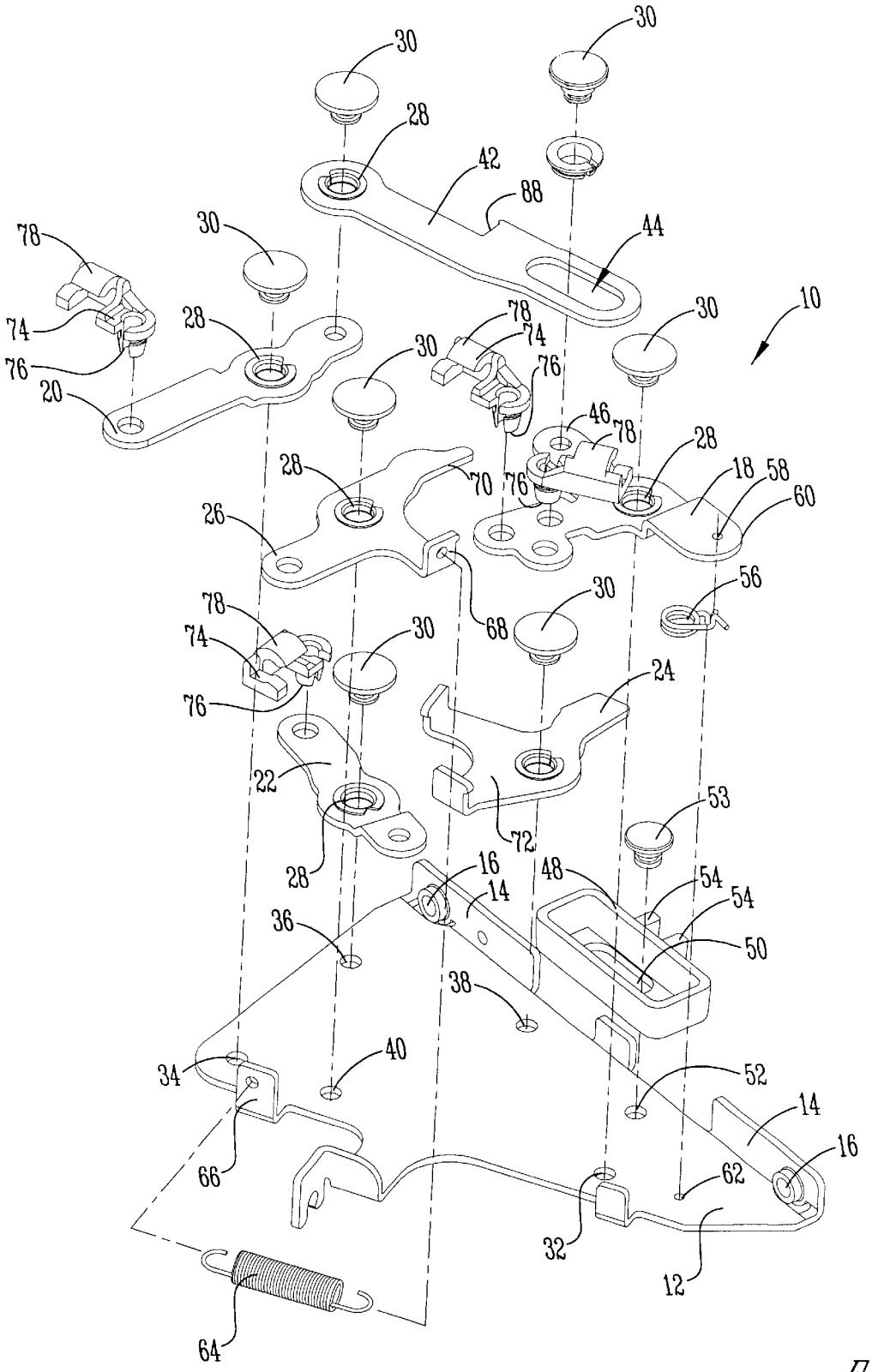
FIG. 1 is an exploded perspective view of the components of the universal logic assembly of the present invention.
Figure 2:
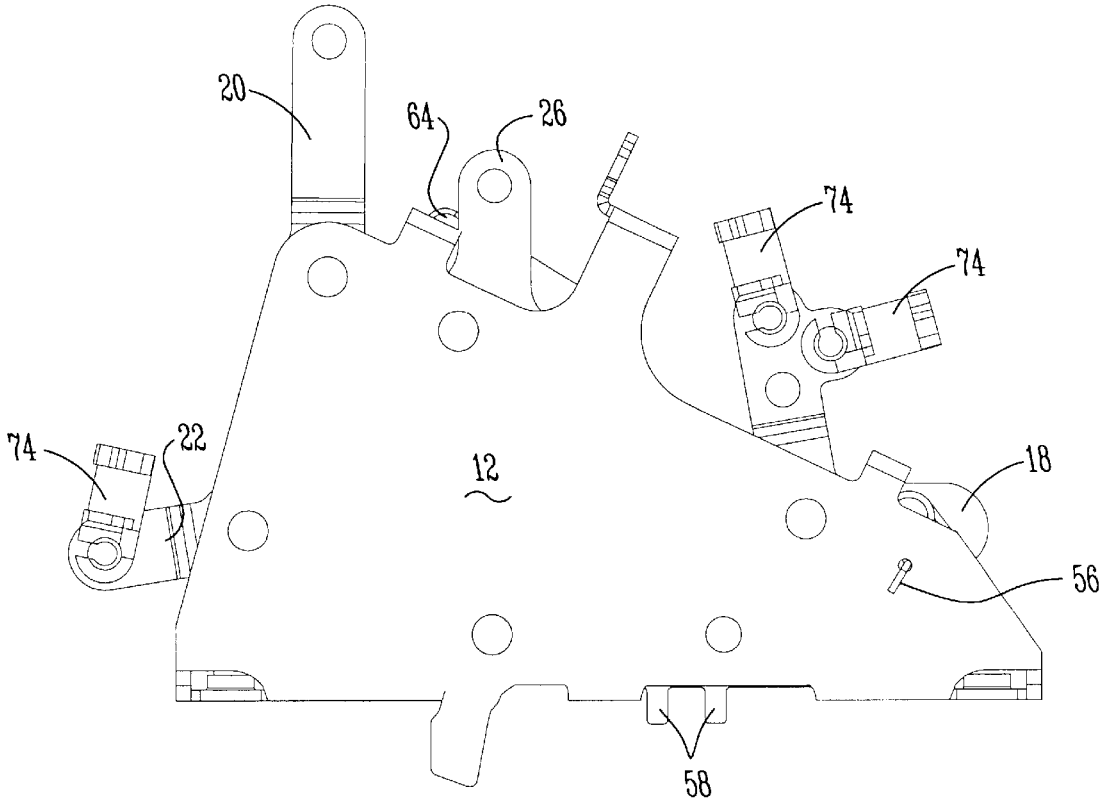
FIG. 2 is a rear elevation view of the logic assembly.

The universal actuator or logic assembly of the present invention is generally designated in the drawings by the reference numeral 10. The logic assembly 10 is adapted for use with a latch in a vehicle door structure. The assembly 10 is universal in that it can be used on both the left-hand and right-hand door structures of the vehicle.

The assembly 10 includes a bracket 12 having a mounting flange 14 extending perpendicularly to the bracket 12. The mounting flange 14 includes a pair of threaded holes 16 for mounting the logic assembly 10 to the door structure, with the latch assembly (not shown) sandwiched therebetween.

The assembly 10 includes a plurality of lever arms mounted on the bracket 12. More particularly, the levers include a lock arm 18, an outside release arm 20, and inside release arm 22, an actuator arm 24, and a spring lever arm 26. Each of these arms 18, 20, 22, 24 and 26 include a central aperture with a bushing 28 for pivotally mounting the respective arm to the mounting bracket 12 via a rivet 30 extending through the central opening in the respective arm and through a corresponding hole 32, 34, 36, 38, and 40 in the bracket 12.

A link arm 42 has an end with a central opening and a bushing 28 therein for pivotal connection to one end of the outside release arm 20, using a rivet 30. The opposite end of the link arm 42 includes an elongated slot 44 which slidably receives a bushing 28 for connection to a leg 46 of the lock arm 18 using a rivet 30.

A slide block 48 includes an elongated slot 50 and is slidably mounted to the bracket 12 using a rivet 30 extending through a hole 52 in the bracket 12. The slide block 48 includes a pair of legs 54 adapted to receive a pin extending from the latch assembly so as to open and close the latch rotor, as discussed below.

An over center spring 56 has a first end extending through a hole 58 in a leg 60 of the lock arm 18. The opposite end of the over center spring 56 is received in a hole 62 in the bracket 12. The over center spring 56 resides between the lock arm 18 and the bracket 12, and provides an opposition torque for the lock arm 18.

An extension spring 64 has one end received in a hole in a flange 66 extending perpendicularly from the bracket 12, as best seen in FIG. 1. The opposite end of the extension spring 64 is received in a hole on a flange 68 extending perpendicularly from the spring arm 26. The extension spring 64 normally biases a leg 70 of the spring arm 26 into engagement with a leg 72 of the actuator arm 24.

A plurality of clips 74 are provided for mounting in the lock arm 18, the outside release arm 20, and the inside release arm 22. More particularly, each clip 74 includes a male stub 76 adapted to snap fit into a corresponding hole in the arms 18, 20 and 22. Each clip 74 also includes a resilient retention member 78 adapted to receive a rod or cable from the door structure to pivot or move the interconnected components and thereby control opening of the latch.

The logic assembly 10 has a narrow profile so as to accommodate internal door mounting. The assembly 10 is also designed to operate under adverse reliability, cyclic, environmental, high door weight, and high door seal load conditions, which are typical for on road and vocational vehicles.

Preferably, the arms 18, 20, 22, 24, 26 and 42 are stamped from CRS 14 AWG steel material, and plated with an option zinc, yellow finish or Nitrotec surface plating to provide protection against galling and wear, and resistance to corrosion. The mounting bracket is preferably manufactured from CRS 11 AWG steel, with a similar plating finish as the arms. The rivets 30 are preferably made from CRS rod material and plated with zinc, yellow finish. The bushings 28 are Teflon impregnated for a zero-zero or line fit with the rivets 30. The rivets thus provide excellent reduction of wear and gall, and have a very low coefficient affliction. The over center spring 56 and extension spring 64 are preferably manufactured from galvanized music wire material. Preferably, the over center spring 56 produces 10–18 in-lbs. of torque. The slidable lock is preferably manufactured from engineered plastic Nylon SIGs.

The universal logic assembly 10 of the present invention thus provides a non-handed input/output mechanism which accepts user input from internal and external door handles, latch actuation devices, and release mechanisms. The user inputs are transferred to an output motion by the logic assembly and then to the latch assembly for opening the vehicle doors. The logic assembly 10 can be used with single or double rotor latch assemblies. The input functions include input from the inside door handle release device, input from the outside door handle release device, input from the sill button lock knob, input from the outside handle lock device, and input from the rotor pin latch component. The output is actuation of the latch assembly catch component, thus causing the latch to open.

Figure 3:
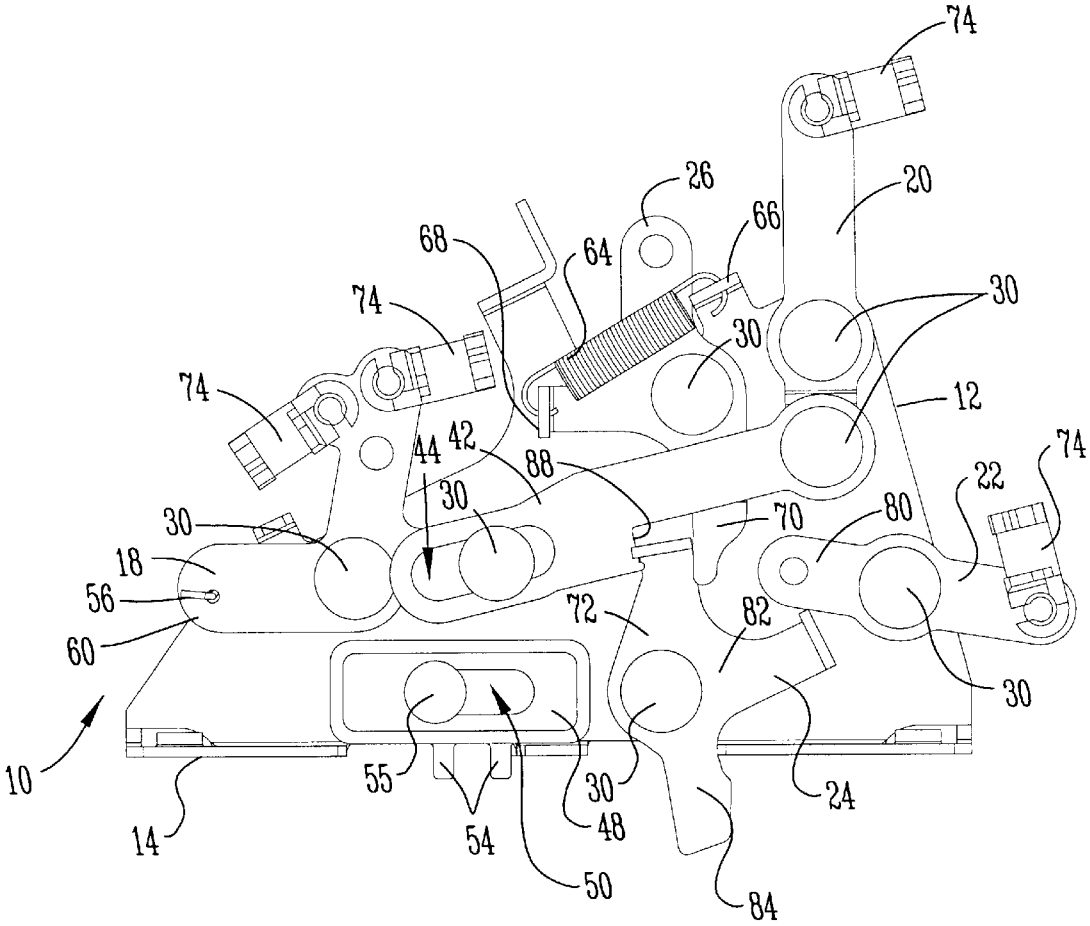
FIG. 3 is a front elevation view of the logic assembly with the arms pivoted to a first position.
Figure 5:
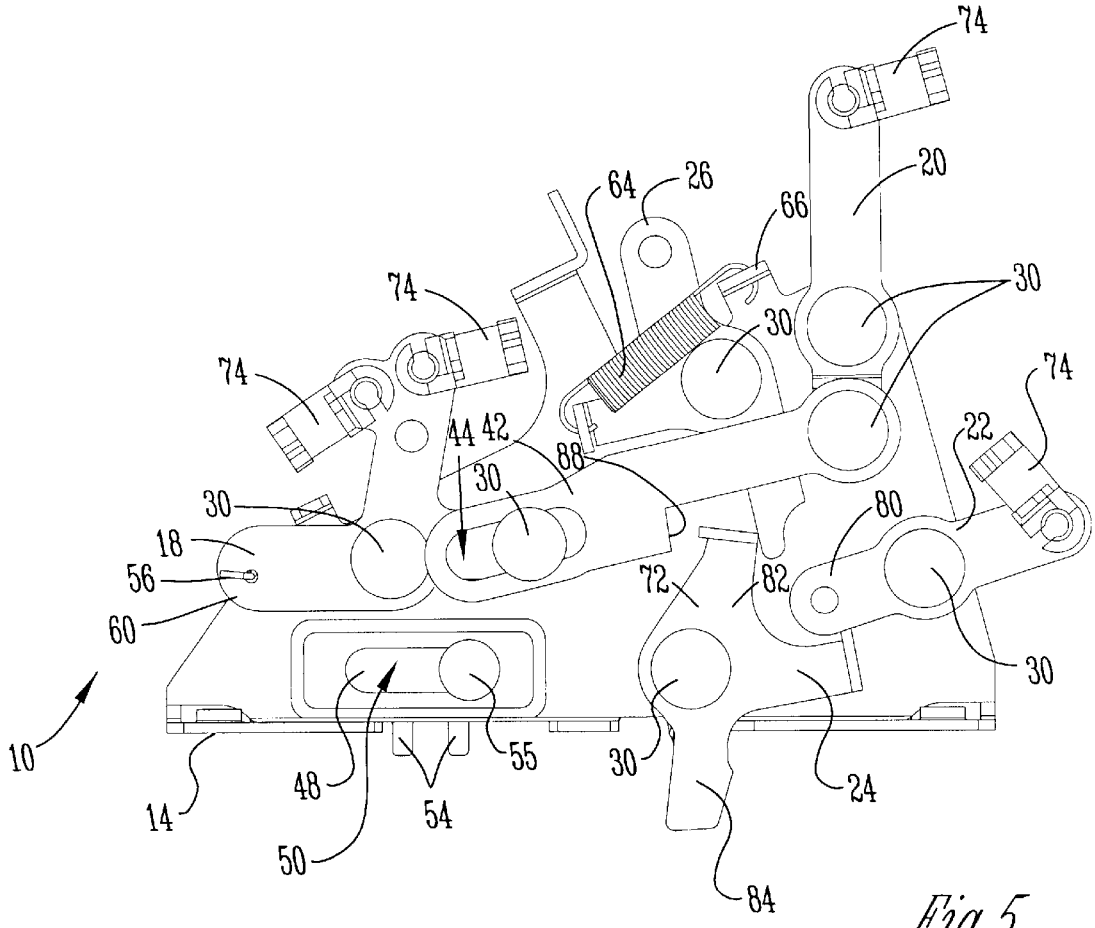
FIG. 5 is a side elevation view similar to FIG. 3 with the inside release arm, spring arm, and slide block moved to a latch-opening position when the inside door handle is actuated.

In operation, when the latch rotor is closed, the lever arms 18, 20, 22, 24, 26 and 42 and the slide block 48 are in the position shown in FIG. 3. When a person in the vehicle actuates the interior door handle, the inside release arm 22 is pivoted in a counterclockwise direction, as seen in FIG. 5, such that the inner end 80 of the arm 22 engages a leg 82 of the actuator arm 24, to thereby rotate the actuator arm in clockwise direction such that a lower leg 84 of the actuator 9 arm 24 pivots the latch catch so as to release the latch rotor to an open position, such that the vehicle door can be opened.

Figure 6:
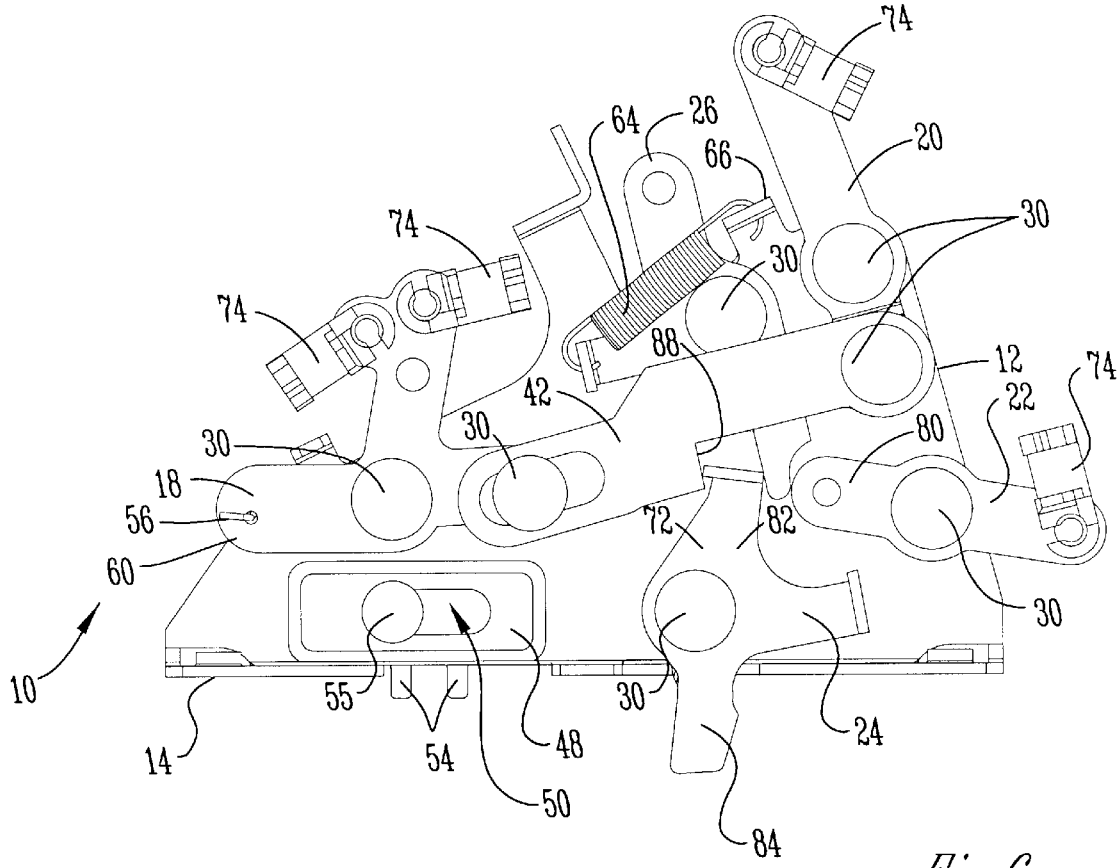
FIG. 6 is a side elevation view similar to FIG. 3 with the outside release arm, spring arm, link arm and actuator arm moved to a latch opening position when the outside door handle is actuated.

When the outside vehicle door handle is actuated, the outside release arm 20 is pivoted counterclockwise, as seen in FIG. 6, such that the end of the arm 20 pulls the link arm 42 towards the right (as seen in FIG. 6), such that a shoulder 88 engages the leg 72 of the actuator arm 24, which in turn releases the latch catch so that the latch rotor moves to an open position, such that the vehicle door can be opened. The extension spring 64 normally biases the spring arm 26 and actuator arm 24 to the initial position shown in FIG. 3.

Figure 4:
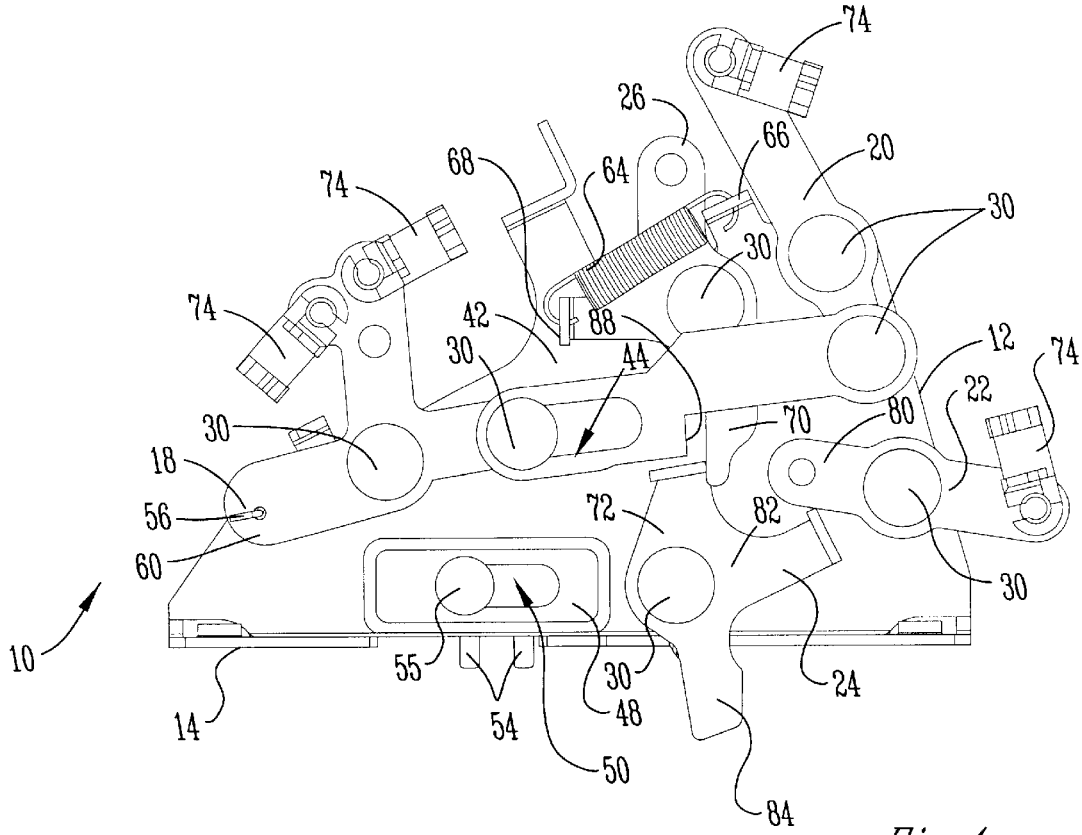
FIG. 4 is a view similar to FIG. 3 with the lock arm, outside release arm, and link arm pivoted to a second position when the vehicle door is locked.

When the vehicle door is closed, the sill button lock knob can be actuated to lock the door. Actuation of the sill lock knob rotates the lock arm 18 in a counterclockwise direction, as shown in FIG. 4, which raises or pivots the link arm 42 such that the shoulder 88 is disengaged from the leg 72 of the actuator arm 24. Accordingly, the latch catch cannot be tripped by the actuator arm 24 if someone lifts or actuates the outside vehicle door handle. Therefore, the door cannot be opened from the outside if the latch is locked. However, actuation of the inside door handle still permits the inside release arm 22 to rotate and pivot the actuator arm 24 to release the latch catch, such that the vehicle door can be opened from the inside.

From the forgoing, it can be seen that the present invention accomplishes at least all the stated objectives.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A universal actuator assembly for a latch mounted on a vehicle door structure, comprising:

a mounting bracket adapted to be attached to the latch and to the door structure;

a plurality of lever arms pivotally mounted on the bracket, each arm having opposite front and back sides;

at least one clip mounted on one of the lever arms and adapted to receive a connector from the door structure so as to control opening and closing of the latch;

the clip being mountable from both the front and back sides of the one arm such that the actuator assembly can be universally used on both left-hand and right-hand door structures.

2. The actuator assembly of claim 1 wherein the lever arms include a lock arm pivotally mounted to the bracket, an outside release arm pivotally connected to the bracket, a link arm pivotally connected to the lock arm and to the outside release arm, a spring arm pivotally connected to the bracket, an inside release arm pivotally connected to the bracket, and an actuator arm pivotally connected to the bracket.

3. The actuator assembly of claim 2 further comprising an over center spring having opposite ends connected to the lock arm and to the bracket to provide torsional resistance to the lock arm.

4. The actuator assembly of claim 2 further comprising an extension spring having opposite ends connected to the spring arm and to the bracket to provide an extension load force to the spring arm.

5. The actuator assembly of claim 4 wherein the arms are adapted to receive input from the door structure and thereby output a desired function to the latch.

6. The actuator assembly of claim 2 wherein a first clip is mounted on the outside release arm and a second clip is mounted on the inside release arm for connection to rods on the door structure.

7. The actuator assembly of claim 2 wherein a pair of clips are mounted on the lock arm for connection to rods on the door structure.

8. The actuator assembly of claim 2 wherein the outside release arm is adapted to be connected to an outside door handle of the door structure for pivotal movement by the handle.

9. The actuator assembly of claim 8 wherein the actuator arm is pivotal in response to pivoting of the outside release arm so as to open the latch.

10. The actuator assembly of claim 2 wherein the inside release arm is adapted to be connected to an inside door handle of the door structure for pivotal movement by the handle.

11. The actuator assembly of claim 9 wherein the actuator arm is pivotal in response to pivoting of the inside release arm so as to open the latch.

12. The actuator assembly of claim 2 wherein the lock arm is adapted to be connected to a lock mechanism of the door structure for movement between lock and unlocked positions.

13. The actuator assembly of claim 12 wherein the actuator arm is precluded from pivoting in response to actuation of an outside door handle of the door structure when the lock arm is in a locked position.

14. An actuator assembly for a vehicle door, the door including inside and outside door handles, a lock mechanism, and a latch, the assembly comprising:

a bracket adapted to be mounted inside the door to cooperate with the latch;

a plurality of lever arms pivotally mounted on the bracket, each arm having opposite sides;

a plurality of clips mounted on certain ones of the lever arms and being adapted to provide connections to the locking mechanism and door handles; and the clips being reversible on the arms such that the actuator assembly is non-handed.

15. The actuator assembly of claim 14 wherein the arms are movable in response to input from the lock mechanism so as to control opening and closing of the lock mechanism.

16. The actuator assembly of claim 14 wherein the arms are movable in response to actuation of the outside door handle to open the latch.

17. The actuator assembly of claim 14 wherein the arms are movable in response to actuation of the inside door handle to open the latch.

* * * * *